United States Patent [19]

Krivda et al.

[11] 4,423,614

[45] Jan. 3, 1984

[54] APPARATUS FOR SHAPING ARTICLES BY ROLLING

[75] Inventors: Leonid T. Krivda; Alexandr S. Pshenishnjuk, both of Kiev; Viktor I. Gromov; Vladimir K. Schukin, both of Tolyatti, all of U.S.S.R.

[73] Assignee: Kievskiy Politekhnichesky Institut of USSR, Kiev, U.S.S.R.

[21] Appl. No.: 286,620

[22] Filed: Jul. 24, 1981

[51] Int. Cl.[3] ..... B21J 13/02

[52] U.S. Cl. ..... 72/115; 72/125; 72/406; 72/418

[58] Field of Search ..... 72/67, 112, 115, 124, 72/125, 406, 418, 448

[56] References Cited

U.S. PATENT DOCUMENTS 1,677,722 7/1928 Lowrie ..... 72/125
2,649,820 8/1953 Hunt ..... 72/115
3,798,944 3/1974 Foster et al. ..... 72/67
3,926,032 12/1975 Brooks et al. ..... 72/448

*Primary Examiner*—Lowell A. Larson
*Attorney, Agent, or Firm*—Murray Schaffer

[57] ABSTRACT

In the upper portion of a frame there is mounted a drive for producing oscillating motion, and a pressing device in kinematic connection therewith. A punch is fixed in the lower portion of the pressing device to operate on a workpiece. Below is mounted a cross piece for reciprocating motion in the vertical direction, including a portion which extends beyond the limits of said frame, which is provided with a vertical through groove adapted to receive the rod of an article being processed. A table is disposed on the upper surface of the cross piece, for reciprocal movement in a horizontal plane. The table is provided with an opening coaxial with the portion of the groove disposed within the punching zone.

4 Claims, 4 Drawing Figures

APPARATUS FOR SHAPING ARTICLES BY ROLLING

BACKGROUND OF THE INVENTION

The present invention relates to equipment for metal working by pressure, and more particularly, to apparatus for shaping articles by rolling.

The invention is most advantageous in punching rod-like articles having a flanged head (e.g. automobile back half-axles).

Shaping articles by rolling have been known for a comparatively long time, but until now a device ensuring an improved rigidity and strength of structural components in punching rod-like articles having a flange without an increase in metal content, and under the conditions of a constantly displacing zone of plastic deformation over the contact surface of the article being processed, in the process of forward motion of the punch has not been developed. Due to localization of the zone of plastic deformation there is the possibility of obtaining finished articles whose dimensions are to the maximum extent approached by the starting workpiece. In this case, such properties as rigidity and strength of structural components of the apparatus, and accordingly of the apparatus as a whole, ensure the precision of the articles being punched.

Known in the art are apparatuses for shaping articles by rolling (such as disclosed in French Pat. No. 2,098,385; U.S. Pat. No. 3,523,442; FRG Pat. No. 1,652,653) each comprising a frame, a mechanism adapted for locally deforming a workpiece being processed, mounted in the upper portion of the frame, a mechanism adapted for axially loading said workpiece mounted in the lower portion of the frame, and a cross piece mounted for reciprocating motion in the vertical direction, said cross piece being in kinematic connection with the mechanism for axial pressure loading. The mechanism for effecting local deformation includes a drive for oscillating motion, and a pressing device which is kinematically connected therewith, with a punch fixed in the lower portion thereof. A die is fixed on the cross piece.

During the operation the work being processed is mounted on the die. At this moment the cross piece is in its lower position. Then the cross piece is lifted together with the die and with the work being processed until the portion of the work surface to be processed contacts the punch, whereafter the mechanism for the local deformation is operated, and the punch while oscillating accomplishes the rolling of the surface of the article being processed.

In the course of processing, the localized zone of plastic deformation shifts over the contact surface of the work being processed.

The mechanism for axial pressure loading, while displacing the cross piece in the vertical direction, presses the surface of the workpiece against the punch during the whole period of punching. After the process of punching is over, the mechanism for the local deformation is disconnected, the cross piece is lowered to remove the resulting article and to charge the next workpiece.

However, when punching flanges of rod-like articles having an elongated shaft, it is necessary to considerably increase the travel path of the cross piece from its lower most position to the point of contact between the surface of the flange of the article and the punch so as to enable charging the workpiece and discharging the resulting product. This leads to a significant increase in the height of the frame thereby affecting its strength and rigidity.

Moreover, the presence of a considerable free-idle running of the cross piece during its elevation results in a significant decrease in the output of the apparatus, and further requires some additional attachments to install rod-like articles.

The above disadvantages have been to a considerable degree eliminated in the design of an apparatus for shaping by rolling disclosed in USSR Author's Certificate No. 651,875. The disclosed apparatus comprises a frame, a mechanism for the local deformation of a workpiece mounted in the upper portion of the frame, and a mechanism for axially loading the workpiece in the form of a hydraulic cylinder disposed in the lower portion of the frame. The body of the hydraulic cylinder is a cross piece mounted below the mechanism for the local deformation for reciprocating motion in the vertical direction.

The mechanism for the local deformation comprises a drive for oscillating motion, and a pressing device being in the kinematic connection therewith, a punch being fixed in the lower portion of the pressing device.

In the lower portion of the frame there is disposed a cradle which is hingedly mounted on pins fixed within the frame. The body of the hydraulic cylinder is disposed in the guides of said cradle, while of a rod of the hydraulic cylinder is fixed in a cross beam of the cradle. The working position of the cradle is locked by a stop mounted on the frame.

The upper surface of the shell of the hydraulic cylinder (the cross piece) is a table with a die fixed thereon. The table with the die is mounted so that it may be removed, when necessary, from the zone of punching by inclining the cradle with respect to the shell of the hydraulic cylinder. In the shell of the hydraulic cylinder (accordingly, both in the cross piece and in the table), there is provided a through opening which is normal to the plane of punching, to receive the rod of the work being processed. The die is also provided with an opening which is coaxial with the opening in the table, and in the cross piece.

The above-described apparatus operates as follows:

In the initial position of the apparatus (when the cradle is included), the work being processed is mounted within the die, while the rod of the work is put into the opening in the shell of the hydraulic cylinder. Then the cradle is rotated until it contacts with the stop and is fixed in the operating position. A high pressure liquid is supplied to the upper cavity of the hydraulic cylinder thereby shifting the shell containing the work being processed until the contact of the surface portion to be shaped with the punch. Following this the mechanism for the local deformation is operated, and the punch which accomplishes oscillating motion, carries out rolling the processed surface of the article. After the process of punching is over, the liquid is fed into the lower cavity of the hydraulic cylinder. In doing this, the shell of the hydraulic cylinder together with the finished article is lowered.

The cradle is inclined, the finished article is removed, and the next workpiece is loaded. Then the cycle is repeated.

The presence in the given apparatus, of the cradle adapted for removing the table and the die from the zone of punching to load and unload a rod-like article being processed, makes it possible to decrease the travel path of the shell (cross piece) of the hydraulic cylinder, thereby decreasing the dimensions of the apparatus. Also, this improves the rigidity and strength of its frame. Moreover, the decrease in the free-idle running of the die allows the efficiency of the given apparatus to be increased to a considerable extent. However, the hinged joint between the cradle and the frame does not ensure sufficient rigidity and strength of the apparatus.

In addition, after the process of punching is over, the cradle is inclined to remove the finished article. The cross piece must be lowered considerably in order to load the next workpiece so as to prevent damage either to the die or to the punch which may otherwise occur as a result of their collision. The above fact leads to a decrease in the productivity of the apparatus as a whole due to the increase in time for accomplishing the free-idle running of the die.

The presence in the apparatus of the drive for inclining the cradle, which drive is of a rather complex design, and of the mechanism for fixing the cradle in both the operating and inclined positions makes the design of the given apparatus more complex.

SUMMARY OF THE INVENTION

The main object of the present invention is to provide apparatus for shaping articles by rolling having a strong and rigid construction.

Another main object of the invention is to increase productivity of the apparatus.

A further object of the invention is to simplify the design of the apparatus.

Still another object of the invention is to ensure reliability and durability of the construction of the apparatus.

According to the present invention an apparatus for shaping articles by rolling is provided, comprising a frame, a mechanism for locally deforming a work being processed mounted in the upper portion of the frame and provided with a drive for oscillating motion and a pressing device being in the kinematic connection therewith. A punch is fixed in the lower portion of the pressing device. A cross piece is mounted below the mechanism for locally deforming said work, for reciprocating motion in the vertical direction a through opening to receive the workpiece is provided in the cross piece opening, normal to the plane of punching. A mechanism for axially loading the workpiece is in kinematic connection with the cross piece. A table is mounted on the upper surface of the cross piece so that it may be shifted from the zone of punching. The table has an opening which is coaxial with the opening in the cross piece. A die piece, is fixed on the table and provided with an opening coaxial with the opening in the table. The cross piece is provided with a portion extending beyond the frame, and the through opening in the cross piece which receives the rod of the workpiece, is a groove connecting the portion with the punching zone. The table is mounted for reciprocating along said groove, and the mechanism for axially loading and work being processed is disposed beyond the travel path of said table.

Such an arrangement of the apparatus makes it possible to remove the resultant product from the zone of punching, and to position the next work by moving the table along the groove, thus eliminating the need to utilize the cradle to achieve the same, and thereby improving rigidity and strength of the apparatus without of the apparatus promotes the attainment of a higher precision of punching. Articles whose dimensions are to the maximum extent approaching the finishing ones can thus be produced.

Such a process is required in working rod-like articles having a large diameter and a small thickness, and provided with flanges (e.g. automobile back half-axles).

Furthermore, the above arrangement makes it possible to simplify the design of a drive for moving the table, and to eliminate the need for fixing the table which simplifies to a considerable extent the design of the apparatus as a whole.

The presence of the table which is mounted for movement along the groove in the cross piece, makes it possible to start removal of the table from the zone of punching immediately after the withdrawal of the punch from the article being processed upon the termination of the process of punching, and lowering the cross piece, thereby combining the displacement of the cross piece with that of the table. This results in an increase in the productivity of the apparatus since time expenditures for unloading and loading articles being processed, is reduced.

To ensure a more convenient loading and unloading and discharging of articles being processed, it is expedient that the portion of the groove disposed on the extending portion of the cross piece be of a length which is more than half the sum of the diameter of the core, and that of the flange of the article being processed.

More simple as to its design is such a modification of the apparatus of the invention wherein the mechanism for axially loading the workpiece is to provide at least two drives for reciprocating travel, mounted under the cross piece in a symmetrical position relative to the groove and connected with said cross piece.

Such a design also makes it possible to obtain the most uniform distribution of the load applied to the cross piece in the process of punching, and promotes an increase in rigidity of the apparatus by decreasing the length of the kinematic links.

The most reliable and durable operation arises from forming the drives of the mechanism for axial loading as hydraulic cylinders. Such a design makes it possible to utilize the liquid contained within the hydraulic cylinders for unloading the spherical portion of the pressing device by means of communicating the cavities of the hydraulic cylinders with the cavity disposed under the spherical portion of the pressing device. In the given case, an optimum result is achieved when the pressure of the liquid varies proportionally to the process loading in the course of punching.

BRIEF DESCRIPTION OF DRAWINGS

The invention will now be explained in greater detail with reference to embodiments thereof which are represented in the accompanying drawings, wherein.

DETAILED DESCRIPTION OF THE INVENTION

Figure 3:
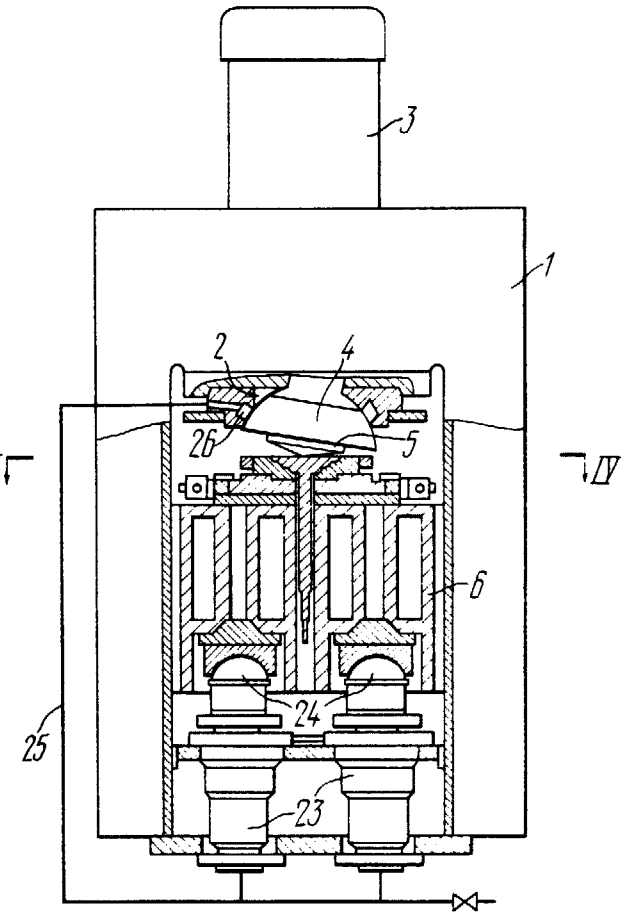
FIG. 3 is a view similar to FIG. 1 showing a modification of the apparatus wherein the mechanism for axial loading is two hydraulic cylinders.

An apparatus for shaping articles by rolling comprises a frame (FIG. 1) with a mechanism 2 for the local deformation of the article being processed, mounted in the upper portion thereof. The mechanism 2 for the local deformation of the article being processed comprises a drive 3 producing oscillating motion, and a pressing device 4 kinematically connected therewith. In the lower portion of the pressing device 4 there is fixed a punch 5. A cross piece 6 is disposed under the mechanism 2 which cross piece is adapted for reciprocating travel along guides 7 (FIG. 2) in the vertical direction. A mechanism 8 (FIG. 2) for axially pressure loading the article being processed, is kinematically connected with the cross piece 6.

Figure 1:
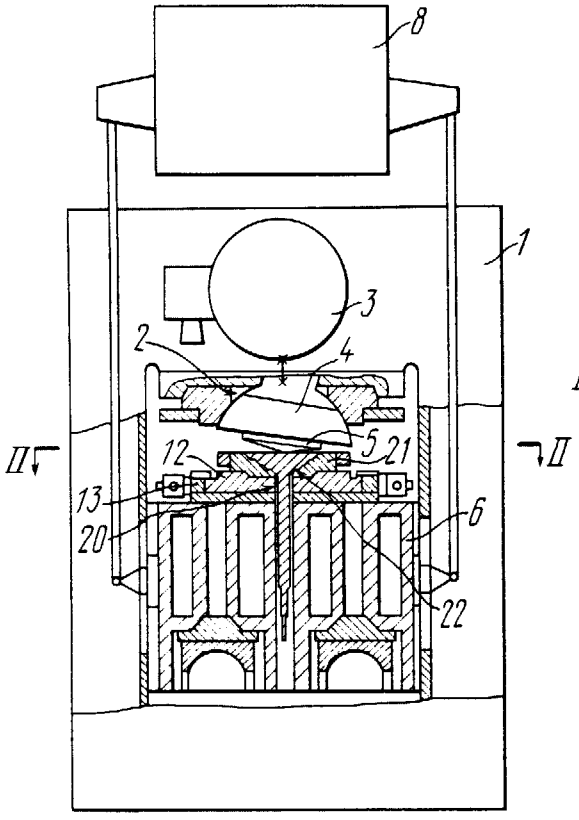
FIG. 1 is an end view partially in section of the apparatus according to the present invention for shaping articles by rolling.
Figure 2:
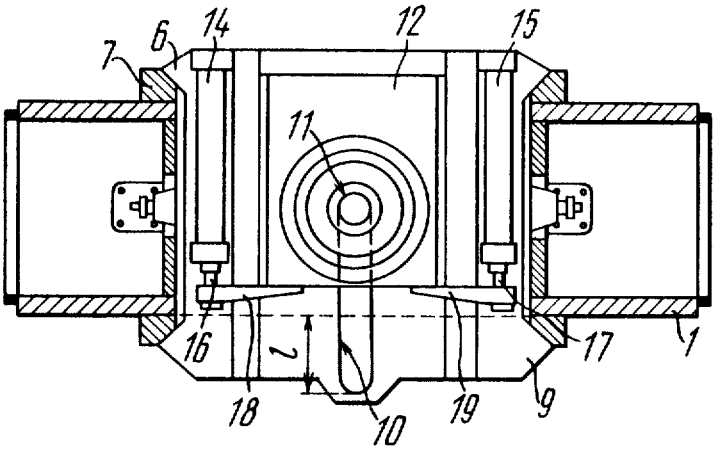
FIG. 2 is a cross-sectional view taken along line II—II of FIG. 1.
Figure 4:
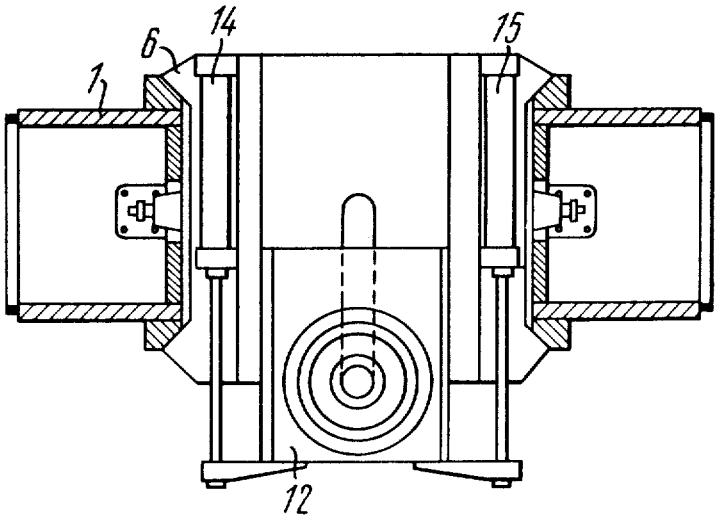
FIG. 4 is a view similar to FIG. 2 showing the support table shifted for the loading or unloading of a workpiece.

According to the invention, the cross piece 6 has a portion 9 (FIG. 2) extending forwardly beyond the side of the frame 1. A through groove 10 having vertical walls adapted to receive the rod of the workpiece being processed, is made in the cross piece 6 (FIG. 1). The groove 10 is made normal to the plane of shaping and connects the extending portion 9 (FIG. 2) of the cross piece 6 with the zone 11 of shaping (FIG. 4).

In the upper portion of the cross piece 6 there is disposed a table 12 (FIG. 1) which is adapted for reciprocating travel in a horizontal plane along guides 13 over the groove 10 so as to remove the table 12 from the zone 11 of shaping. The table 12 is kinematically connected with a drive constructed in the form of two pneumatic cylinders 14 and 15 (FIG. 2), whose rods 16 and 17 are rigidly connected to brackets 18 and 19 fixed respectively to said table 12. In the middle portion of the table 12 there is provided an opening 20 which is coaxial with a portion of the groove 10 disposed in the zone 11 of punching.

A die 21 having an opening 22 coaxial with the opening 20 of said table 12, is fixed on said table 12 (FIG. 1).

According to the invention, the mechanism 8 for axial loading the article being processed, is disposed beyond the travel path of the table 12.

In order to ensure the most practicable loading and unloading of the articles being processed, beyond the limits of the frame 1 (FIG. 2), the portion of the groove 10 which is disposed on the extending portion 9 of the cross piece 6 is, according to the invention, of a length of which is more than half the sum of the diameter of the core (e.g. rod) and that of the flange of the article being processed.

FIG. 3 of the accompanying drawings shows a modification of the inventive apparatus, having the simpliest design. In this modification the mechanism 8 for axially loading the workpiece being processed is, according to the invention, made in the form of at least two drivers for reciprocating travel mounted below the cross piece in the symmetrical position relative to the groove 10, and connected with said cross piece 6.

The design of the drives of the mechanism 8 for axial loading can be different. However, the most reliable and durable in operation is a modification of the inventive apparatus wherein, according to the invention, said drives are made in the form of hydraulic cylinders 23 whose rods 24 are fixed within the cross piece 6.

The lower cavities of the hydraulic cylinders 23 communicate by means of a pipeline 25 with a cavity 26 in the support for the spherical portion of the pressing device 4 of the mechanism 2 for the local deformation.

FIG. 4 of the accompanying drawings shows the inventive apparatus wherein the table 12 is shifted from the zone 11 of punching to unload a finished article and to load an unworked article.

The above-described apparatus operates as follows.

In the starting position the table 12, with the die 21, is removed from the zone 11 of punching (FIG. 4). An unworked rod-like article 30 is mounted (either by hand or using a manipulator) within the die 21 in such a manner that the rod is disposed within the opening 20 of the table 12 as can be seen in FIG. 1. Following this, the pneumatic cylinders 14 and 15 are operated (FIG. 2), and the table 12, the die 21, and the article being processed, are shifted into the zone 11 of punching. Simultaneously, the mechanism 8 (FIG. 1) for axial loading, and the mechanism 2 for the local deformation, are operated. The cross piece 6 together with the table 12, the die 21, and the article being processed, is shifting upwardly until the surface being processed of the article contacts the punch 5 which is then caused to carry out oscillating movements together with the pressing device 4.

In the process of punching, the localized zone of plastic deformation shifts over the contact surface of the article being processed. In doing, this, the mechanism 8 for axial loading pressed the contact surface of the article being processed, to the punch 5 throughout the whole process of punching.

After the process of punching is over, the mechanism 8 for axial loading is switched over to reverse running, and the cross piece 6 is lowered. At the same time, the mechanism 2 for the local deformation is connected, and the pneumatic cylinders 14 and 15 are operated thus shifting the table 12 together with the die 21 and the finished article along the groove 10 to remove the article from the zone 11 of punching beyond the frame 1. Following this, the finished article is removed (either by hand or using a manipulator) from the die 21, and the next unworked article is loaded. Then the cycle is repeated.

The modification of the inventive apparatus shown in FIG. 3 of the accompanying drawings operates essentially as described above. However, in order to displace the cross piece 6 together with the supported table 12, the die 21, and the workpiece 30, until the surface being processed contacts the punch 5, a high pressure liquid is supplied into the lower cavity of the hydraulic cylinders 23, and the rods 24 of said hydraulic cylinders 23 shift the cross piece 6 upwardly.

In the process of punching, the liquid is fed from the lower cavities of the hydraulic cylinders 23 via the pipelines 25, into the cavity 26 disposed below the spherical portion of the pressing device 4 of the mechanism 2 for the local deformation, to unload the spherical portion.

In doing this, the pressure of the liquid changes proportionally to the change of the process loading in the course of punching.

After the process of punching is over, the liquid is drained off from the lower cavities of the hydraulic cylinders 23, and is supplied into the upper cavities of said hydraulic cylinders 23, thereby causing the downward travel of the cross piece 6.

While the invention has been described herein in terms of specific examples, which are to be taken as preferred, numerous variations and modifications apparent to those skilled in the art, may be made in the invention.

Also possible are other modifications of the apparatus of the invention without departing from the spirit and scope thereof as set forth in the appended claims.

What is claimed is:

1. Apparatus for shaping a workpiece having an elongated rod and a flanged head into articles by rolling, comprising:

(a) a frame;

(b) means for locally deforming said workpiece said means being mounted in the upper portion of said frame and having a drive for producing oscillating motion;

a pressing device in kinematic connection with said drive and, a punch fixed in the lower portion of said pressing device;

(c) a cross piece mounted below said means for locally deforming said workpiece for reciprocating movement in the vertical direction, said cross piece having.

a portion extending from said frame;

a through groove defined by walls and adapted to receive the rod of the workpiece, said groove being normal to the plane of punching and connecting said extending portion with the zone of punching;

(d) a table mounted on the upper portion of said cross piece for reciprocating in a horizontal plane along said groove to move from the zone of punching, said table being provided with an opening which is coaxial with the portion of said groove within the zone of punching;

(e) means for axially loading the workpiece said means being kinematically connected with said cross piece, and disposed beyond the travel path of said table and, (f) a die fixed on said table and having an opening in said table.

2. The apparatus of claim 1 wherein the portion of said groove on said extending portion of said cross piece is longer than half the sum of the diameter of the rod and that of the flange of the work being processed.

3. The apparatus of claim 1 wherein said means for axially loading the workpiece comprises at least two reciprocating drives mounted under said cross piece in a symmetrical position relative to the walls of the groove, and connected with said cross piece.

4. The apparatus of claim 3 wherein said drives are hydraulic cylinders.

* * * * *